US008041282B2

(12) United States Patent
Haruno et al.

(10) Patent No.: US 8,041,282 B2
(45) Date of Patent: Oct. 18, 2011

(54) POWDER CONTAINER, CLEANING DEVICE, AND IMAGE FORMING APPARATUS

(75) Inventors: Katsuhito Haruno, Sagamihara (JP); Masaharu Furuya, Yokohama (JP); Takuya Sekine, Yokohama (JP); Masakazu Imai, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 288 days.

(21) Appl. No.: 12/423,159

(22) Filed: Apr. 14, 2009

(65) Prior Publication Data

US 2009/0257799 A1 Oct. 15, 2009

(30) Foreign Application Priority Data

Apr. 15, 2008 (JP) ..... 2008-105340
Aug. 8, 2008 (JP) ..... 2008-206160

(51) Int. Cl.
*G03G 21/12* (2006.01)

(52) U.S. Cl. ..... 399/360

(58) Field of Classification Search ..... 399/101, 399/360, 358, 27, 24, 30, 58, 64
See application file for complete search history.

(56) References Cited

U.S. PATENT DOCUMENTS

| | | | | |
|---|---|---|---|---|
| 6,516,172 | B1 * | 2/2003 | Kimura | 399/360 |
| 6,937,838 | B2 * | 8/2005 | Ishii et al. | 399/358 |
| 7,099,617 | B2 * | 8/2006 | Jeong et al. | 399/358 |
| 7,103,308 | B2 * | 9/2006 | Wakana | 399/358 |
| 7,373,092 | B2 * | 5/2008 | Tawada | |
| 7,660,541 | B2 * | 2/2010 | Tanimoto et al. | |
| 2006/0193648 | A1 * | 8/2006 | Kadowaki et al. | |
| 2006/0269305 | A1 * | 11/2006 | Murakami et al. | 399/358 |
| 2007/0264036 | A1 * | 11/2007 | Craig et al. | 399/358 |
| 2008/0317484 | A1 * | 12/2008 | Tanimoto et al. | |

FOREIGN PATENT DOCUMENTS

| | | | |
|---|---|---|---|
| JP | 05188835 | A * | 7/1993 |
| JP | 3183733 | | 4/2001 |
| JP | 2001-296777 | | 10/2001 |
| JP | 2005-49528 | | 2/2005 |
| JP | 4076461 | | 2/2008 |

* cited by examiner

*Primary Examiner* — Susan Lee
(74) *Attorney, Agent, or Firm* — Oblon, Spivak, McClelland, Maier & Neustadt, L.L.P.

(57) ABSTRACT

A powder container includes a first container to contain powder falling from an opening located in an upper portion of the powder container, a second container that contains the powder and is located in the first container, on a route through which the powder that falls from the opening, a powder transport mechanism to transport the powder from the first container to the second container, and a detection mechanism to detect whether or not the first container is completely or nearly filled with the powder based on a load to the powder transport mechanism.

14 Claims, 10 Drawing Sheets

POWDER CONTAINER, CLEANING DEVICE, AND IMAGE FORMING APPARATUS

CROSS-REFERENCE TO RELATED APPLICATIONS

This patent specification claims priority from Japanese Patent Application Nos. 2008-105340 and 2008-206160, filed in the Japan Patent Office on Apr. 15, 2008 and Aug. 8, 2008, respectively, the entire contents of which are hereby incorporated by reference herein.

BACKGROUND OF THE INVENTION

1. Field of the Invention

The present invention relates to an image forming apparatus such as a copier, a printer, and a facsimile machine, and more particularly, to an image forming apparatus provided with a cleaning device including a powder container.

2. Discussion of the Background

In general, an electrographic image forming apparatus, for example, a copier, a printer, a facsimile machine, etc., includes an image forming mechanism for forming an electrostatic image carrier on an image carrier, such as a photoconductor, for developing the latent image; a transfer member for transferring the developed image onto a recording medium; and a fixing member for fixing the image thereon. Typically, the image forming apparatus also includes a cleaning device to collect any residual toner adhering to the image carrier. The toner collected by the cleaning device is transported, for example, to a waste-toner container in the image-forming apparatus as waste toner.

In recent years, a need has arisen to make the image forming apparatus compact. However, the above-described image forming apparatus, in which the waste toner is transported from the cleaning device to the waste-toner container, requires a transporting mechanism to transport the waste toner from the cleaning device to the waste-toner container, and thus, the image forming apparatus body is complicated and increases in size.

Several approaches have been proposed to solve the above-described problem.

In one known method, a cleaning member that is attached to a housing of the cleaning device collects a waste toner. The waste toner is contained in a waste-toner container formed in an interior space of the housing. Since the waste toner collected by the cleaning member is contained in the waste-toner container in the cleaning device itself, the image forming apparatus can be simplified and reduced in size because it does not require a transporting mechanism.

Further, the waste-toner container includes an optical sensor that detects whether or not the waste-toner container is filled with waste toner. When the optical sensor detects that the waste-toner container is filled with waste toner, then, for example, the image forming apparatus displays on a display panel a message that prompts a user to replace the waste-toner container.

In another known method, an image forming apparatus includes a waste-toner container that includes a toner detection space provided separately from a main waste-toner containing space as a protrusion from a part of a sidewall of the waste-toner container. The toner detection space is continuous with the waste-toner containing space, and the waste toner overflows into the toner detection space from the waste-toner containing space when the waste-toner containing space is filled with waste toner.

An optically transmissive material is used for the sidewall forming the waste-toner detection space, and a light emitting part and a light receiving part of an optical sensor arrangement are located so as to sandwich the outside walls defining the waste-toner detection space. As the waste-toner container fills with waste toner, the waste toner enters the toner detection space from the toner containing space and blocks the light from the light emitting part to the light receiving part of the optical sensor, the optical sensor detects that the waste-toner container is filled with waste toner.

However, in the image forming apparatus having such a configuration, waste toner floating in the waste-toner container can adhere to the sidewall of the waste-toner containing space, blocking the light from the light emitting part to the light receiving part of the optical sensor. In this instance, the optical sensor detects that the waste-toner container is filled with waste toner in error, even through the waste-toner container is not filled with waste toner and the waste toner does not enter the toner detection space.

Moreover, the waste-toner detection space is formed as a projection beyond the part of the sidewall of the waste-toner container, thus increasing the size of the waste-toner container increases accordingly.

As the waste-toner container thus increases in size, the space that the waste-toner container occupies in the image forming apparatus grows larger and proportionally increases the size of the image forming apparatus, neither of which is desirable.

SUMMARY OF THE INVENTION

In view of foregoing, one illustrative embodiment of the present invention provides a powder container that includes a first container to contain powder falling from an opening located in an upper portion of the powder container, a second container that contains the powder and is located in the first container, on a route through which the powder that falls from the opening, a powder transport mechanism to transport the powder from the first container to the second container, and a detection mechanism to detect whether or not the first container is completely or nearly filled with the powder based on a load to the powder transport mechanism.

In view of foregoing, one illustrative embodiment of the present invention provides a cleaning device that includes a cleaning component to collect a powder from an object to be cleaned, and the powder container described above to contain the powder that is collected by the cleaning component and falls under its own weight.

In view of foregoing, one illustrative embodiment of the present invention provides an image forming apparatus comprising, an image forming unit to form an image on an image carrier, and the cleaning device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
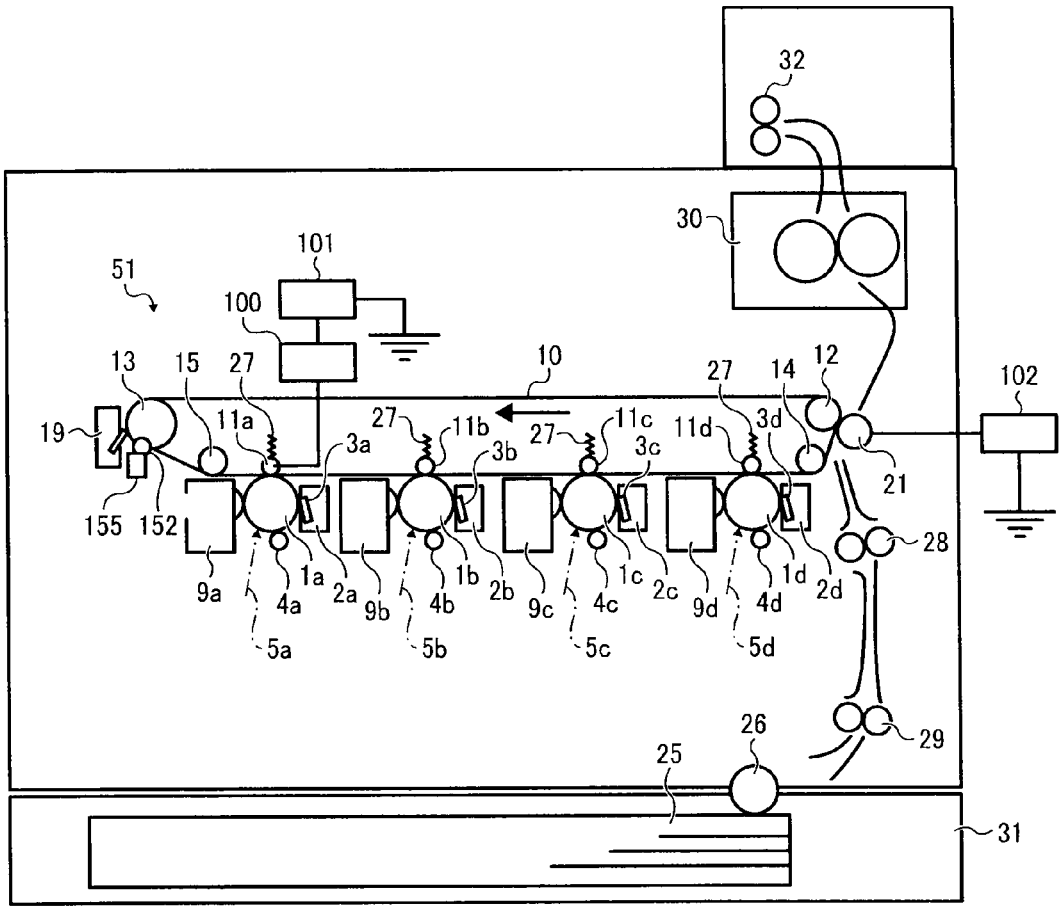
FIG. 1 is a schematic diagram illustrating a configuration of an image forming apparatus according to one illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, particularly to FIG. 1, an electrographic image forming apparatus that is a tandem type multicolor printer (hereinafter simply referred to as a printer) according to an example embodiment of the present invention is described below.

It is to be noted that although the image forming apparatus of the present embodiment is a printer, the image forming apparatus of the present invention is not limited to a printer.

FIG. 1 is a schematic diagram illustrating a configuration of an image forming apparatus, in this instance the printer described above.

Referring to FIG. 1, the printer includes an intermediate transfer unit 51 that is detachably attached to a printer body. The intermediate transfer unit 51 includes a driving roller 12, a tension roller 13, and supporting rollers 14 and 15, and an intermediate transfer belt 10 that serves as an image carrier is wound around these rollers.

It is to be noted that the driving roller 12 is driven by a driving motor, not shown, and is adjusted to move at a process velocity of 150 mm/s.

The intermediate transfer belt 10 has an electrical resistance such that a toner image can be transferred from a photoconductor 1 to be described below onto the intermediate transfer belt 10. More specifically, the intermediate transfer belt 10 is a single-layered or multi-layered belt formed of, for example, polyvinylidene fluoride (PVDF), ethylene-tertrafluoroethylene (ETFE), polyimide (PI), polycarbonate (PC), and the like.

Additionally, in order to adjust the resistance, a conductive material such as carbon black is dispersed in a layer of the intermediate transfer belt 10 so that a volume resistivity thereof is adjusted to within a range from $10^8$ Ωcm to $10^{12}$ Ωcm, and a surface resistivity thereof is adjusted to within a range from to $10^9$ Ωcm to $10^{13}$ Ωcm.

It is to be noted that the surface of the intermediate transfer belt 10 may be coated with a release layer as appropriate. Examples of a material used for the release layer include, but not limited to, fluorocarbon resins such as ethylene-tetrafluoroethylene (ETFE), polytetrafluoroethylene (PTFE), polyvinylidene fluoride (PVDF), perfluoroalkoxy polymer resin (PFA), fluorinate ethylene-propylene (FEP), and polyvinylfluoride (PVF).

The intermediate transfer belt 10 can be manufactured through a cast molding method, a centrifugal molding method, and so on, and if necessary, the surface of the intermediate transfer belt 10 may be polished.

The volume resistivity and the surface resistivity can be measured by connecting a HRS Probe having an inner electrode diameter of 5.9 mm and an (inner) ring caliber of 11 mm (Mitsubishi Chemical, Ltd) to a high resistivity meter, Hiresta IP, (Mitsubishi Chemical, Ltd). The volume resistivity is calculated by measuring a current that flows through the intermediate transfer belt 10 after 10 seconds has elapsed when a voltage of 100 V is applied to both sides of the intermediate transfer belt 10 via two electrodes attached to both sides thereof. The surface resistivity is calculated by measuring a current that flows on the surface of the intermediate transfer belt 10 after 10 seconds has elapsed when a voltage of 500 V is applied to two electrodes pressing against the surface of the intermediate transfer belt 10.

The printer of the present embodiment includes four image forming units for forming black, yellow, magenta, and cyan images, respectively, disposed along a moving area of a lower portion of the intermediate transfer belt 10.

It is to be noted that the subscripts a, b, c, and d attached to the end of each reference numeral indicate only that components indicated thereby are used for forming yellow, magenta, cyan, and black images, respectively, and hereinafter may be omitted when color discrimination is not necessary.

Each image forming unit includes the photoconductor 1 as a latent image carrier, a cleaning device 2 provided with a cleaning blade 3 that cleans a surface of the photoconductor 1, a charging device 4 as a charging mechanism, and a development device 9 as a developing mechanism.

It is to be noted that each arrow 5 indicates a writing light from an optical writing device, not shown, serving as a latent image forming unit that forms a latent image on the photoconductor 1 and located in a lower portion of the printer.

In the printer, each transfer bias roller 11 pressed by a press coil 27 contacts the intermediate transfer belt 10 in the intermediate transfer unit 51 and faces each photoconductor 1. A predetermined or given transfer bias voltage is applied to each transfer bias roller 11 by power sources 100 and 101. In the present embodiment, a voltage of +1800 V is applied to each transfer bias roller 11.

Further, a secondary transfer roller 21 is provided in close proximity to the surface of the intermediate transfer belt 10 where the intermediate transfer belt 10 is wound around the driving roller 12, and a predetermined or given secondary transfer bias is applied to the secondary transfer roller 21 by a power source 102. A portion between the portion of the intermediate transfer belt 10 wound around the driving roller 12 and the secondary transfer roller 21 is a secondary transfer position.

The secondary transfer roller 21 includes a metal core formed of a metal such as SUS steel and an elastic body including urethane robber wrapped around the metal core. The elastic body is adjusted to have a resistance value of within a range from 106Ω to $10^{10}$Ω using an electrically conductive material.

The resistance value of the secondary transfer roller 21 is measured as follows:

The secondary transfer roller 21 is set on a conductive metal plate, and a load of 4.9 N is applied to each end portion of the metal core (both side 9.8 N). Then, the resistance value is calculated based on an electrical current that flown when a voltage of 1000V is applied to between the core metal and the conductive metal plate under these conditions.

The secondary transfer roller 21 is given a driving force by a driving gear, not shown, and a peripheral velocity of the secondary transfer roller 21 is adjusted to a velocity similar to that of the intermediate transfer belt 10.

The printer further includes a feed roller 26 that feeds a transfer sheet 25 as a recording medium, a pair of transport rollers 29, a pair of registration rollers 28, a sheet feeder 31, a fixing device 30, and a discharge roller 32.

In the printer, the latent image that is formed on the photoconductor 1 in each image forming unit by the light writing device, not shown, is developed by the development device 9, and therefore, a single-color toner image, that is, black (Bk), yellow (Y), magenta (M), or cyan (C) image is formed. Then, the toner images formed in the respective image forming units are sequentially transferred onto the intermediate transfer belt 10 and superimposed one on another thereon, and a multicolor toner image is formed on the intermediate transfer belt 10.

The transfer sheet 25 is fed by the feed roller 26, the pair of transport rollers 29, and the pair of registration rollers 28, timed to coincided with when a leading edge of the multicolor image on the intermediate transfer belt 10 reaches the secondary transfer position, thus transferring the multicolor image on the intermediate transfer belt 10 onto the transfer sheet 25 by the secondary transfer roller 21.

It is to be noted that a secondary transfer bias is controlled with a constant electrical current, the constant current is set to +30V (μA).

Then, the transfer sheet 25 on which the multicolor toner image is transferred is transported to the fixing device 30 after being discharged by a discharging device, not shown. Then, the multicolor toner image is fixed on the transfer sheet 5 by the fixing device 30. Thereafter, the transfer sheet 25 is discharge to a stack portion located in an upper portion of the printer by a pair of the discharge roller 32.

Additionally, the printer includes a belt-cleaning unit 19 that removes powder, such as toner from the surface of the intermediate transfer belt 10, and includes a lubrication member 152 and a solid lubricant 155.

Figure 2:
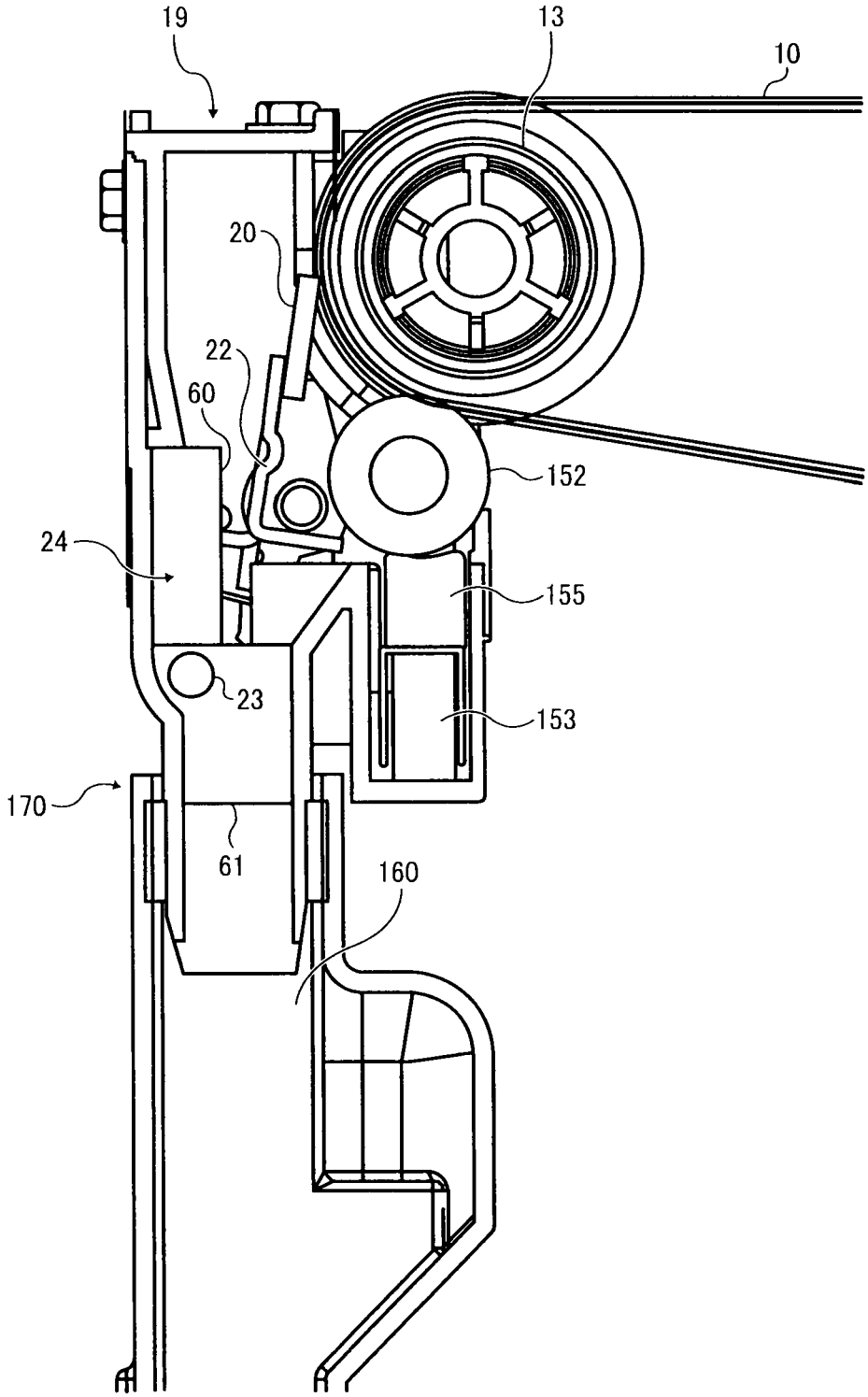
FIG. 2 is an enlarged view illustrating periphery of a belt-cleaning unit included in the printer shown in FIG. 1.
Figure 3:
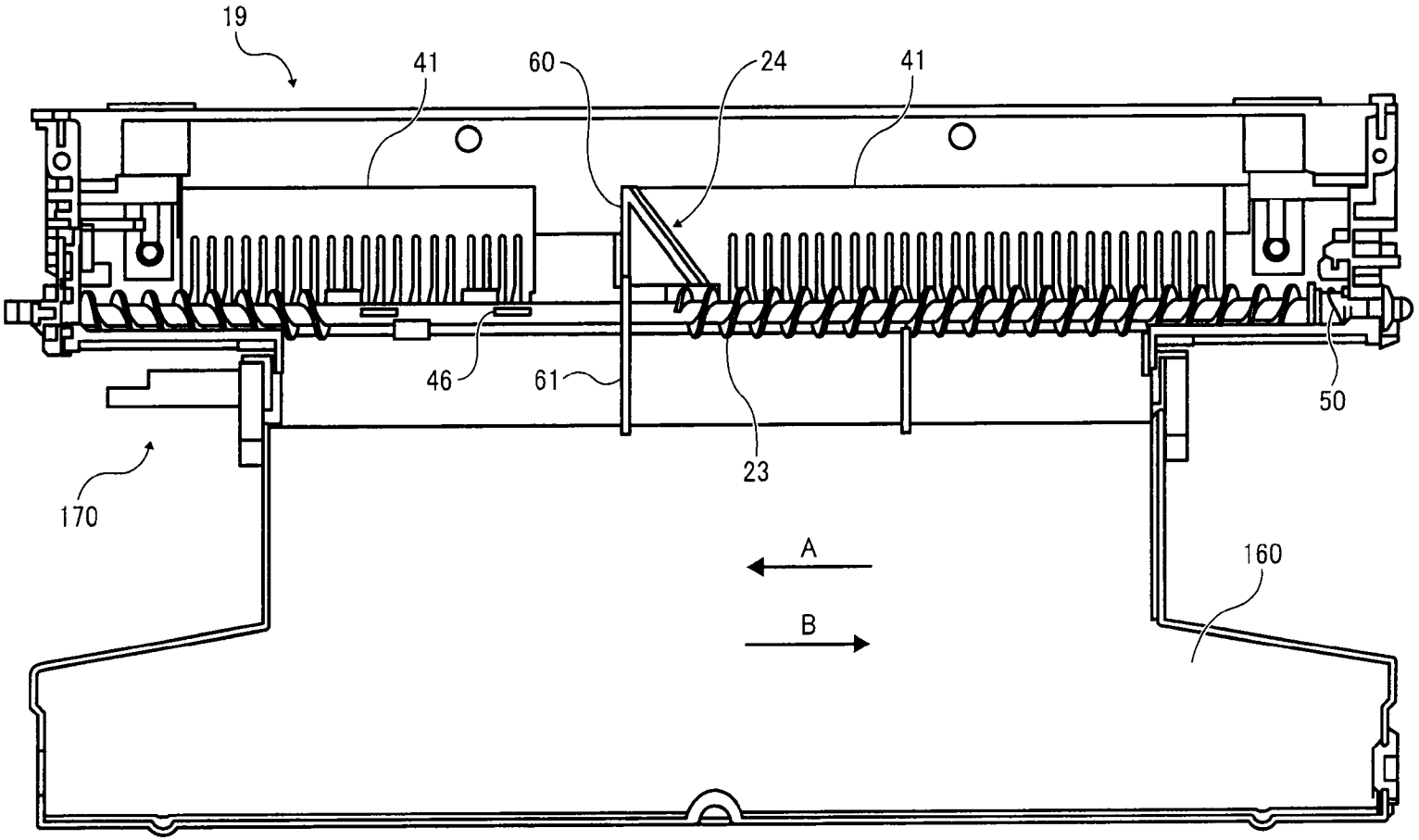
FIG. 3 is a schematic cross-sectional view illustrating a configuration of the belt-cleaning unit shown in FIG. 2.

Referring to FIG. 2 and FIG. 3, the belt-cleaning unit 19 is described in detail below. FIG. 2 is an enlarged view illustrating the periphery of the belt-cleaning unit 19. As shown in FIG. 2, the belt-cleaning unit 19 includes a cleaning blade 20 that is formed of a urethane rubber and the like, and is held by a blade holder 22.

Moreover, an opening is located in close proximity to the cleaning blade 20, in an area where the intermediate transfer belt 10 faces the belt-cleaning unit 19. By pressing the cleaning blade 20 against the intermediate transfer belt 10 in this opening, the residual toner is removed from the intermediate transfer belt 10. The toner thus removed is dropped into the belt-cleaning unit 19 and is contained a waste-toner tank described below.

In order to facilitate cleaning of the intermediate transfer belt 10 by the cleaning blade 20, the belt-cleaning unit 19 includes the solid lubricant 155 that is applied to the surface of the intermediate transfer belt 10 by the lubrication member 152. The belt-cleaning unit 19 further includes a waste-toner tank 160, a toner-collecting container 170 serving as a powder container, shielding walls 60 and 61, and a shielded enclosure 24. The cleaning blade 20 serves as a cleaning component, and the intermediate transfer belt 10 is an object to be cleaned by the cleaning blade 20.

As for the solid lubricant 155, a fatty acid metal salt that includes liner hydrocarbons is used. The fatty acid metal salt is composed of at least one kind of fatty acid selected from stearic acid, palmitic acid, myristic acid, or oleic acid; and at least one metal selected from zinc, aluminum, calcium, magnesium, and lithium. Zinc stearate is the preferred material due to its quality stability and reliability and because it is available in industrial-scale amounts and has a proven record of accomplishment in many fields.

However, a higher fatty acid metal salt that is used industrially generally includes not only a single chemical compound represented by its name, but also includes more or less other similar fatty acid metal salts, metal oxides, and/or free fatty acid, and accordingly the fatty acid metal salt of the present application is no exception.

The solid lubricant 155 is supplied bit by bit in powder form, as described in detail below.

That is, the solid lubricant 155 that is solidified like a block is scraped off and is applied to the intermediate transfer belt 10 by the lubrication member 152 such as a brush. Alternatively, the lubricant can be externally added to toner particles so as to be supplied to the intermediate transfer media together with the toner particles.

However, when the lubricant is supplied by attaching the lubricant externally to toner particle, an amount of the lubricant to be supplied to the intermediate transfer belt depends on the area of output images, and therefore, the lubricant cannot be supplied to an entire surface of the intermediate transfer belt 10 reliably.

For this reason, in order to supply the solid lubricant 155 to the entire surface of the intermediate transfer belt 10 with a simple configuration stably, the solid lubricant 155 is scraped off and applied to the intermediate transfer belt by a brush type of the lubrication member 152, as in the printer according to the present embodiment.

In the present embodiment, in order to scrape off the solid lubricant 155 with the brush type lubrication member 152, a lubricant press mechanism 153 that is an elastic body such as a spring presses the solid lubricant 155 against the lubrication member 152 with a force within a range from 1 N to 4 N.

The lubrication member 152 has a width of over 304 mm because the width should be wider than an image width.

Similarly, the solid lubricant 155 should have a width wider than that of the solid lubricant 155 so that the lubrication member 152 can scrap the solid lubricant 155 uniformly.

It is to be noted that the toner used in the present embodiments polymerized toner formed through a polymerization method. Further, the toner used in the present embodiment preferably has a first shape factor SF1 and a second shape factor SF2 both within a range of 100 to 180.

Moreover, a volume average particle diameter of the toner is desirably within a range from 4 μm to 10 μm. The toner used in the present embodiment has a volume average particle diameter of 6.5 μm.

FIG. 3 is a schematic cross-sectional view illustrating a configuration of the belt-cleaning unit 19 of the image forming apparatus.

The toner adhered to the surface of the intermediate transfer belt 10 falls under its own weight to a bottom of the waste-toner tank 160 (serving as a first container) that is a waste toner container of the toner-collecting container 170, after the toner is scraped off by the cleaning blade 20 provided in the belt-cleaning unit 19. On the route through which the waste toner scraped off by the cleaning blade 20 falls to the bottom of the waste-toner tank 160, the shielding walls 60 and 61, the shielded enclosure 24, and a transport screw 23 are located. As described below, the shielded enclosure 24 is enclosed by the shielding wall 60 and 61 and a transport-passage forming member that is not shown in FIG. 3. The transport screw 23, serving as a powder transport mechanism, transports the waste toner to the shielded enclosure 24. The belt-cleaning unit 19 further includes a cleaning member vibrator 46 that is described below with reference to FIG. 10.

It is to be noted that the transport-passage forming member, not shown, is designed to sandwich the transport screw 23 in a direction horizontal to an axis of the transport screw 23 and forms a transport passage. The transport-passage forming member intersects with the shielding wall 61.

Further, the transport-passage forming member is not disposed in a direction vertical to the axis of the transport screw 23, but an upper space and a lower space is connected through intermediary of the transport screw 23, serving as a connecting mechanism.

Therefore, the waste toner that is scraped off by the cleaning blade 20 is able to fall to the bottom of the waste-toner tank 160 by slipping through the transport screw 23 and the transport passage. Moreover, the transport screw 23 transports the waste toner from outside toward a center portion in the waste-toner tank 160 (hereinafter "waste-toner transport direction") in an axial direction of the transport screw 23 with the shielding wall 61 as a boundary.

As in the configuration described above, when the shielded enclosure 24, serving as a second container, is located in the route through which the waste toner that is scraped off by the cleaning blade 20 and falls to the bottom of waste-toner tank 160, the toner accumulates on a top surface of shielded enclosure 24.

Then, as the waste toner continues to accumulate on the shielded enclosure 24 with time, there is a possibility that the waste toner leaks outside from the opening near the cleaning blade 20.

Therefore, in the present embodiment, the upper surface of the shielded enclosure 24 is sloped, thereby enabling the waste toner to fall easily along the slope and thus preventing the waste toner from accumulating on the top surface of the shielded enclosure 24. The sloped top surface of the shielded enclosure 24 serves as a waste toner accumulation preventer.

Moreover, in the present embodiment, the belt-cleaning unit 19 includes a cleaning member 41 that cleans the top surface of the shielded enclosure 24. As the cleaning member 41, an elastic sheet with slits is used, and a slit portion is designed to interdigitate with the blades of the transport screw 23.

Accordingly, as the transport screw 23 rotates, the slit portion of the cleaning member 41 is flicked, and the cleaning member 41 oscillates. Thus, the waste toner adhered to the top surface of the shielded enclosure 24 is flicked off, and as a result, the cleaning member 41, serving as an accumulation preventer, cleans the top surface of the shielded enclosure 24.

Figure 4:
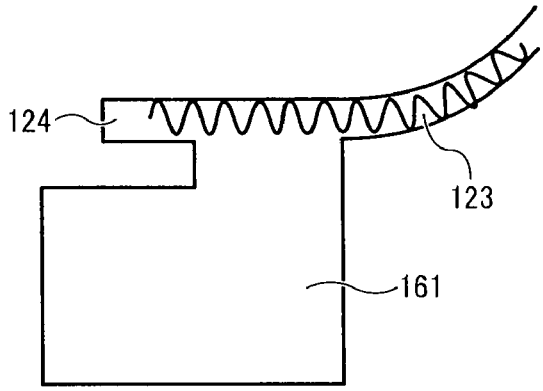
FIG. 4 is a schematic diagram illustrating a configuration of a belt-cleaning unit according to a comparative example, in which a sidewall of a waste-toner tank partly protrudes outside for forming a shielded enclosure.

FIG. 4 illustrates a belt-cleaning unit 119 according to a comparative example.

Referring to FIG. 4, in the belt-cleaning unit 119, a part of a sidewall of a waste-toner tank 161 protrudes outside, in which a shielded enclosure is located, and the waste toner is transported to a shielded enclosure 124 by a transport screw 123.

Such a configuration can prevent the waste toner from accumulating on a top surface of the shielded enclosure 124 and from leaking outside from the opening.

However, the shielded enclosure 124 is located in a portion formed by protruding outside a part of the sidewall of the waste-toner tank 161, and thus, the waste-toner tank 161, in other words, the belt-cleaning unit 119, increases in size by just than much. Because the printer increases in size proportionally, this configuration is not preferable.

By contrast, in the belt-cleaning unit 19 in the printer according to the present invention, the shielded enclosure 24 is located in the route through which the waste toner falls, which can reduce accumulation of the waste toner on the top surface of the shielded enclosure 24. Therefore, the leakage of the waste-toner from the opening can be reduced. Additionally, the belt-cleaning unit 19 including the waste-toner tank 160 requires a smaller space in the printer, and therefore, the size of printer can be reduced.

When accumulation of the waste toner in the waste-toner tank 160 is relatively small in amount, the waste toner can fall to the bottom of waste-toner tank 160 by slipping through the transport screw 23 and transport passage.

Figure 5:
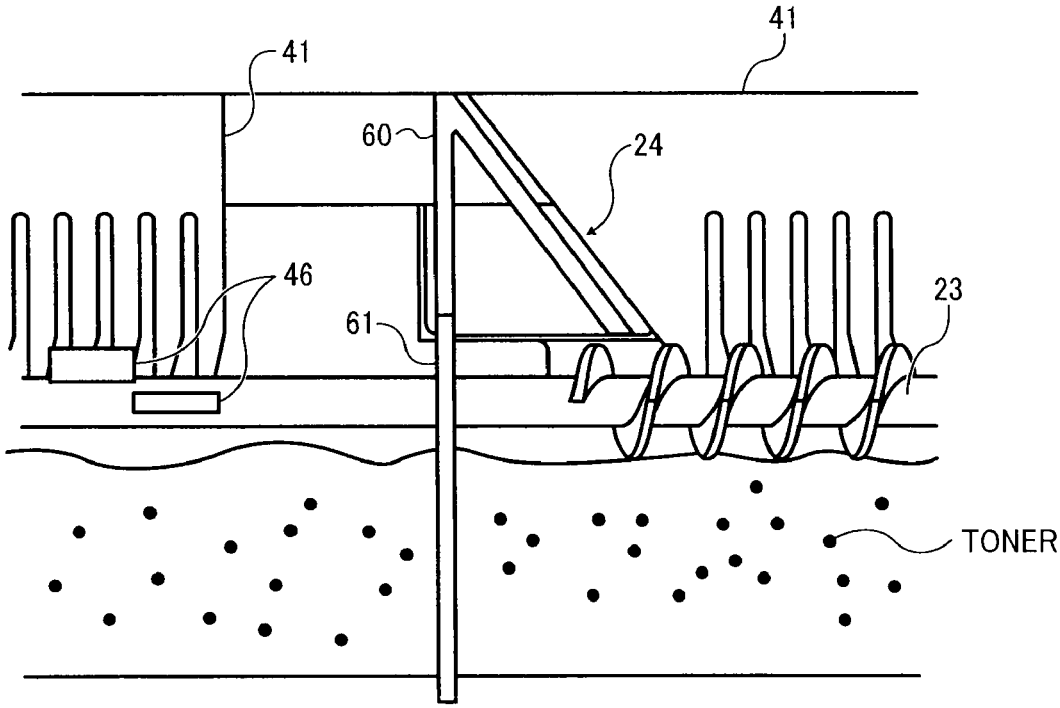
FIG. 5 is a schematic diagram illustrating the belt-cleaning unit when waste toner has accumulated to close to a lower portion of a transport screw.

However, as shown in FIG. 5, when the waste toner has accumulated to close to a lower portion of the transport passage, a bottom of the transport passage is filled with the accumulated waste toner, and therefore, the waste toner itself serves as a bottom wall of the transport passage.

It the present embodiment, the above-described state in which the waste-toner tank 160 (waste-toner container) is completely or nearly filled with the waste toner is hereinafter called "filled state". Then, when the waste toner has accumulated in the waste-toner tank 160 until the filled state is attained, the waste toner that accumulates after the filled state can be transported to the shielded enclosure 24 by the transport screw 23.

The waste toner is transported into the shielded enclosure 24 by the transport screw 23 in the filled state as described above. Subsequently, referring to FIG. 6, when the waste toner can no longer be put into the shielded enclosure 24 because the shielded enclosure 24 is filled with the waste toner, the transport screw 23 receives a pressure from concentrated toner from a direction (indicated by an arrow B in FIG. 3), that is opposite the direction in which the waste toner is transported.

The transport screw 23 can move in the axial direction and is pressed by a spring 50 to the left (in a direction indicated by arrow A) in FIG. 3. When the force of the waste toner to press the transport screw 23 is greater than the force of the spring 50 to press the transport screw 23, the transport screw 23 begins to move in the direction (to the right in FIG. 3) opposite the direction in which the waste toner is transported.

Figure 7:
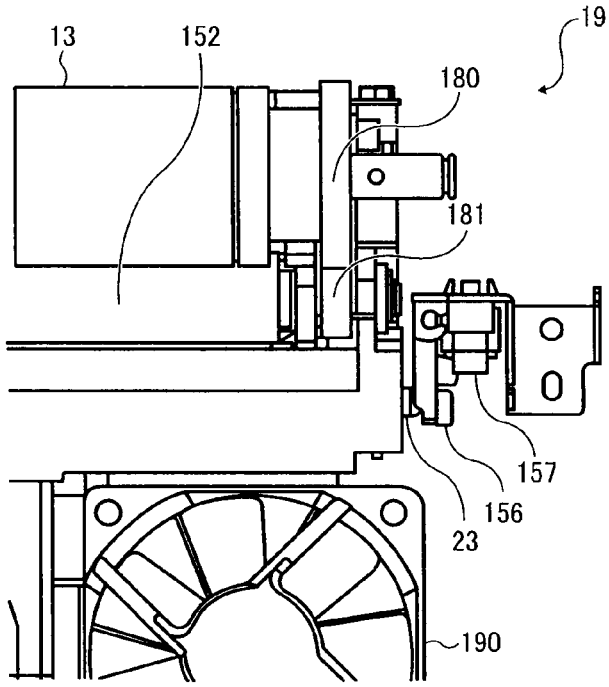
FIG. 7 is magnified external view illustrating the belt-cleaning unit near one end of the transport screw in an axial direction.

The transport screw 23 rotates by receiving a driving force as described below. Referring to FIG. 7, the lubrication member (hereinafter also "brush roller") 152 obtains the driving force from a gear 180 provided on an axis of the tension roller 13 via a gear 181 provided on an axis of the brush roller 152.

Figure 8:
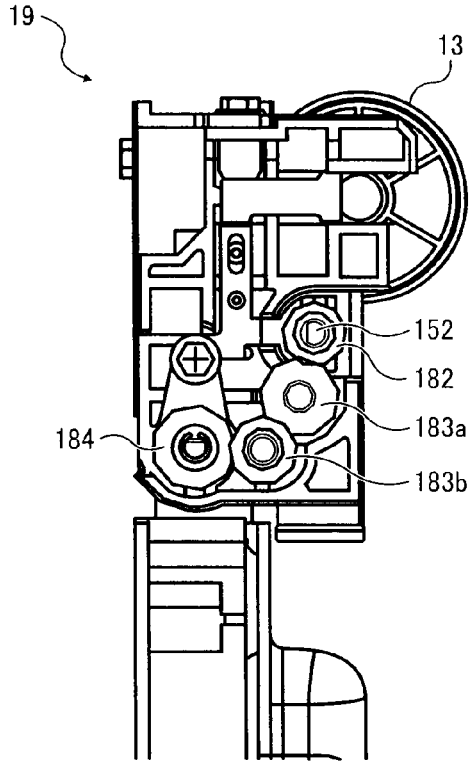
FIG. 8 is a side view illustrating the belt-cleaning unit on side provided on a gear to transmit a driving force to the transport screw.

Further, referring to FIG. 8, by transmitting the driving force of the brush roller 152 to a gear 184 provided on the axis of the transport screw 23 from a gear 182 provided on the axis of the brush roller 152 via a gear 183*a* and a gear 183*b*, the transport screw 23 is rotated.

It is to be noted that the gear 184 can move in the axial direction of the transport screw 23.

Figure 9:
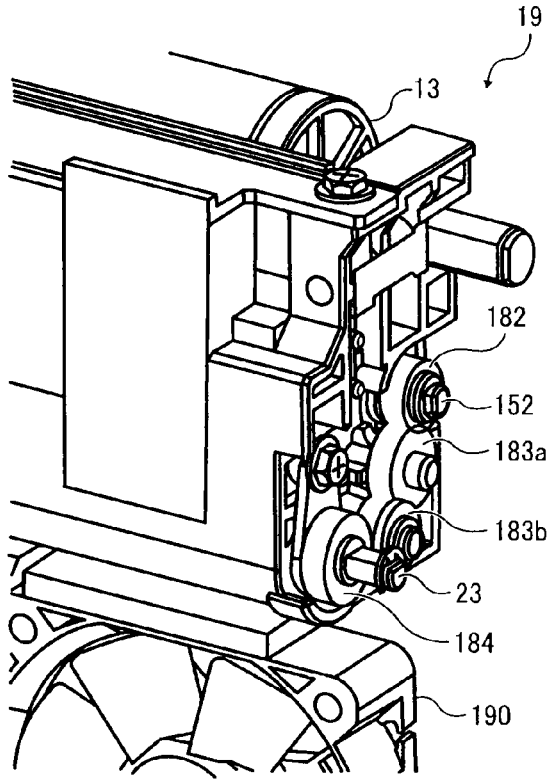
FIG. 9 is a perspective view illustrating the belt-cleaning unit on side provided on a gear to transmit the driving force to the transport screw.

Additionally, referring to FIG. 9, the gear 184 has an anti-skid guard and can prevent the gear 184 from slipping. Therefore, the gear 184 can move in the axial direction of the transport screw 23 while the transport screw keeps rotating.

In the present configuration, by detecting a state in which the transport screw 23 cannot put the waste toner into the shielded enclosure 24 and begins to move in the direction opposite the waste-toner transport direction, receiving a stress load from the waste toner, by a position sensor for detecting a position of the transport screw 23, the filled state of the waste-toner tank 160 can be detected.

In the present configuration, as shown in FIG. 7, the printer further includes an optical sensor 157 as the position sensor for detecting the position of the transport screw 23 and a filler 156. As shown FIG. 10, in which the belt-cleaning unit 19 is viewed in a direction identical to that in which the belt-cleaning unit 19 shown in FIG. 3 is viewed, in the present configuration, the optical sensor 157 includes a light emitting part and a light receiving part both located outside the wall of the waste-toner tank 160 on the side of the spring 50 in the axial direction of the transport screw 23.

When the filler 156 is pressed by the axis of the transport screw 23 that has moved in the direction opposite the direction in which the waste toner is transported, the light of the optical sensor 157 is blocked by the filler 156. Thus, the optical sensor 157 can detect whether or not the waste-toner tank 160 is filled with waste toner.

Further, in the present embodiment, when the axis of the transport screw 23 has moved 3 mm, for example, in the direction opposite the waste-toner transport direction, the light from the light emitting part to the light receiving part of the optical sensor 157 is blocked.

When the optical sensor 157 thus detects the filled state of the waste-toner tank 160, the printer displays on a display panel, not shown, a message indicating that the waste-toner tank 160 is completely or nearly filled with the waste toner.

In the present embodiment, whether or not the waste-toner tank 160 is completely or nearly filled with the waste toner is detected as described above. Therefore, the present configuration can eliminate an error that arises in a configuration in which the optical sensor detects the filled state by detecting that the light from the optical sensor is blocked by the waste toner in the waste-toner tank 160.

Figure 10:
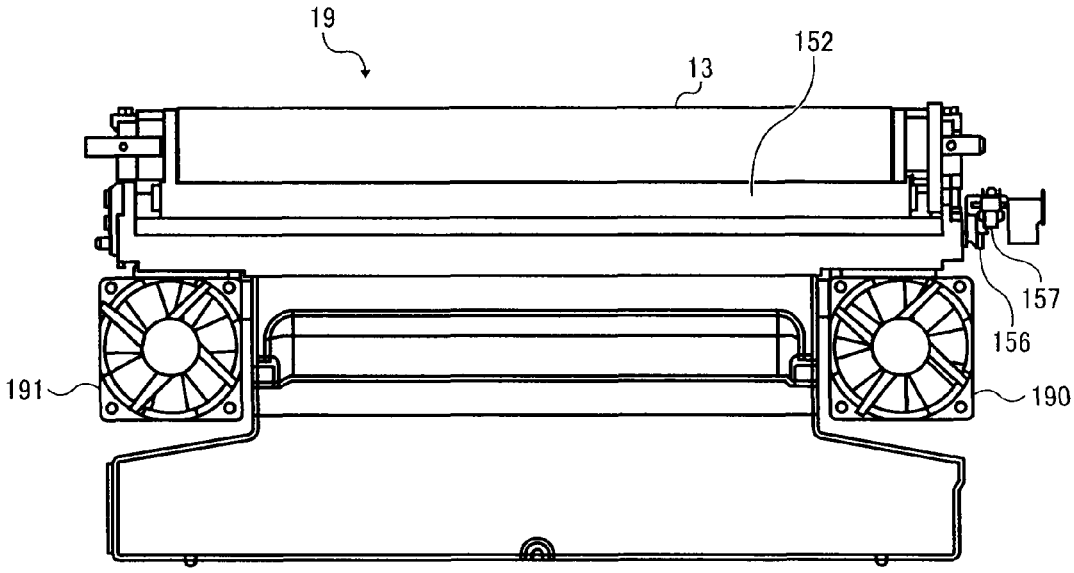
FIG. 10 is an external view illustrating the belt-cleaning unit.
Figure 11:
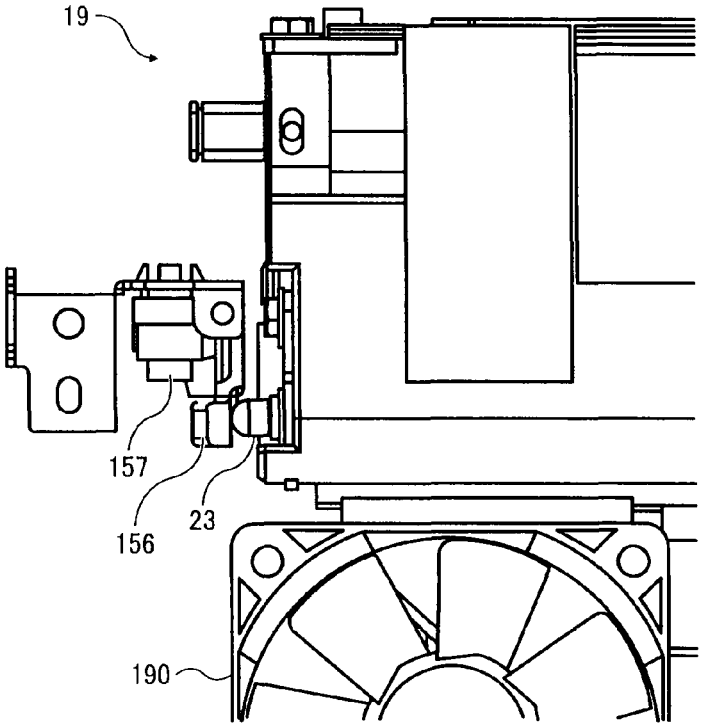
FIG. 11 is a magnified view illustrating an optical sensor and surrounding area.

Further, in the present embodiment, air is taken into the printer by fans 190 and 191 located on the belt cleaning unit 19 to cool the image forming unit as shown in FIG. 10.

In FIGS. 3 and 10, the transport screw 23 transports the waste toner from an end to a center portion in the axial direction of the transport screw 23 in both a right side area and a left area that sandwich the shielding wall 61. That is, in the right side area, the transport screw 23 transports the waste toner from the right to the left, and in the left side area, the transport screw 25 transports the waste toner from the left to right the in FIGS. 3 and 10.

In the present embodiment, in the left side area, a downstream side of the transport screw 23 is not screw-shaped as shown in FIG. 3. Instead, the downstream side of the transport screw 23 includes the cleaning member vibrator 46 that does not have a function to transport the waste toner.

For example, if the transport screw 23 is screw-shaped in the whole left side area from the upstream to the downstream in the direction in which the waste toner is transported, when the waste-toner tank 160 is completely or nearly filled with the waste toner, the waste toner that has accumulated to the position of the transport screw 23 can be transported to the shielding wall 61 in the left side area by the transport screw 23. After the waste toner is transported to the shielding wall 61, the waste toner cannot move downstream in the direction in which the waste toner is transported in the left side area.

In this way, because the waste toner can no longer move downstream in the direction in which the waste toner is transported in the left side area, the transport screw 23 receives the pressure from concentrated toner from the direction opposite the direction in which the waste toner is transported in the left side area (indicated by an arrow A in FIG. 3).

Consequently, when the waste-toner tank 160 is completely or nearly filled with the waste toner, the transport screw 23 receives pressure in two directions from the concentrated toner. One is the pressure in the direction opposite the direction in which the waste toner is transported in the right side area (indicated by an arrow B in FIG. 3), and the other is the direction opposite the direction in which the waste toner is transported in the left side area (indicated by an arrow A in FIG. 3), which are hereinafter referred to as the pressure in the opposite direction in the right area and in the left area, respectively.

Therefore, when the waste-toner tank 160 is in such a filled state, the distance traveled by transport screw 23 in the direction opposite the direction in which the waste toner is transported in the right side area (indicated by an arrow B in FIG. 3) is reduced by an amount corresponding to an amount of the pressure in the opposite direction in the right area (indicated by an arrow B in FIG. 3) that is cancelled out by the pressure in the opposite direction in the left area (indicated by an arrow A in FIG. 3). Consequently, the accuracy of the optical sensor 157 to detect the filled state of the waste-toner tank 160 will be reduced.

By contrast, when the transport screw 23 is not screw-shaped in the downstream side in the direction in which the waste toner is transported in the left side area as in the present embodiment, the waste toner is not transported to the shielding wall 61. Accordingly, the transport screw 23 does not receive the pressure from the concentrated waste toner to the direction opposite the direction in which the waste toner is transported in the left side area (indicated by an arrow A in FIG. 3), and therefore, accuracy of detection of the filled state can be prevented from deteriorating.

In the present embodiment, because the cleaning member 41 is vibrated by a screw-shaped portion of the transport screw 23, vibration efficiency of the cleaning member 41 will be reduced by simply forming the transport screw 23 without the screw-shaped portion.

Figure 6:
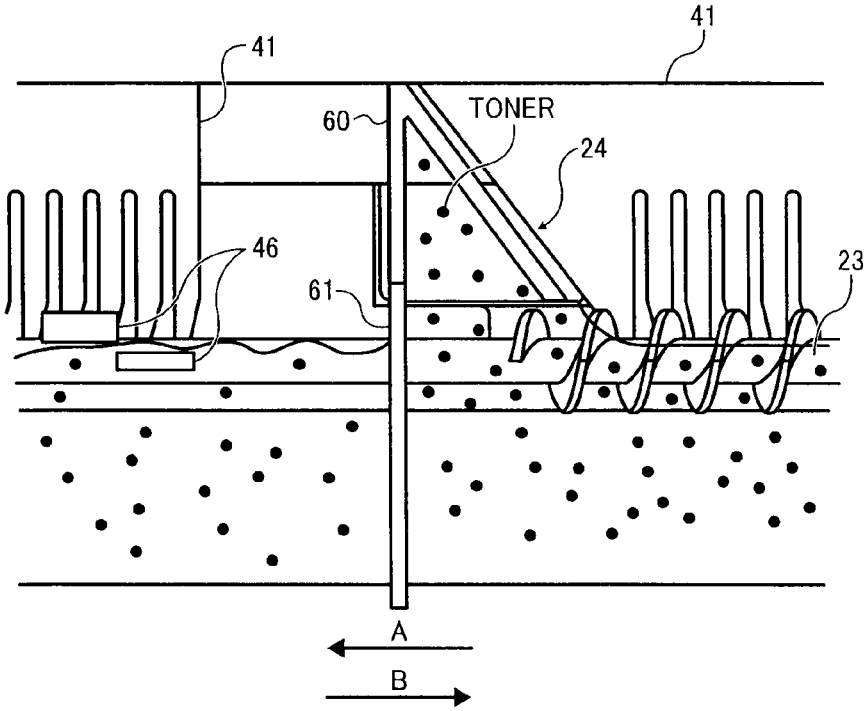
FIG. 6 is a schematic diagram illustrating the belt-cleaning unit when a shielded enclosure 24 and the transport screw area are filled with the waste toner, which is a filled state.

To solve this problem, in the present embodiment, the transport screw 23 is not screw-shaped in downstream side in the direction in which the waste toner is transported in the left side area, and additionally, the transport screw 23 includes the cleaning member vibrator 46 that has no ability to transport the waste toner downstream, as shown in FIG. 6. Therefore, the configuration prevents the transport screw 23 from receiving the pressure from the concentrated waste toner to the direction opposite the direction in which the waste toner is transported in the left side area (indicated by an arrow A in FIG. 8), even if the waste-toner tank 160 is completely or nearly filled with the waste toner.

Consequently, when waste-toner tank 160 is in the filled state, in the right side area, the transport screw 23 receives pressure in a single direction opposite the direction in which the waste toner is transported (indicated by an arrow B in FIG. 6); and therefore, in the right side area, the transport screw 23 is moved in the direction opposite the direction in which the waste toner is transported (indicated by an arrow B in FIG. 6).

Therefore, even when waste-toner tank 160 is in the filled state, the distance traveled by the transport screw 23 is not reduced, and the configuration of the present embodiment can prevent a decrease in the accuracy of the detection that the waste-toner tank 160 is in the filled state using the position detection sensor.

Moreover, in the present embodiment, not by simply omitting the screw-shaped portion of the transport screw 23 in the downstream side in the direction in which the waste toner is transported but by also including the cleaning member vibrator 46, a transport force of the transport screw 23 in the direction indicated by an arrow A in FIG. 8 in the left side area can be reduced while vibration efficiently of the cleaning member 41 can be prevented from deteriorating.

In the present embodiment, the cleaning member vibrator 46 includes multiple vibrators each of which has a height similar to that of a spiral wing of the transport screw 23 and a width similar to one pitch of the spiral wing of the transport screw 23. Further, the vibrators of the cleaning member vibrator 46 are arranged uniformly radially from a center of the axis of the screw member 23, and an arrangement area of the cleaning member vibrator 46 in the axial direction of the transport screw 23 is similar to that of the cleaning member 41.

Furthermore, when the transport screw 23 has moved in the direction opposite the direction in which the waste toner is transported in the right side area (indicated by an arrow B in FIG. 3), in the event that the transport screw 23 moves an excessive distance in the above described direction indicated by an arrow B, a right end portion of the transport screw 23 might collide with the casing of the cleaning unit 19.

If such collision occurs, the end portion of the transport screw 23 is pressed against the casing because the transport screw 23 receives pressure from the waste toner in the direction indicated by an arrow B in the shielded enclosure 24.

In this state, a resistance that inhibits the transport screw 23 from rotating is generated between the transport screw 23 and the casing, and thereby the transport screw 23 might be damaged and the rotation of the transport screw 23 might be blocked.

Therefore, to avoid the above-described situation, in the present embodiment, when the transport screw 23 has moved in the opposite direction indicated by the arrow B, the cleaning unit 19 is designed to prevent the transport screw 23 from colliding with the casing of the cleaning unit 19, which is described below with reference to FIGS. 12 and 13.

Figure 12:
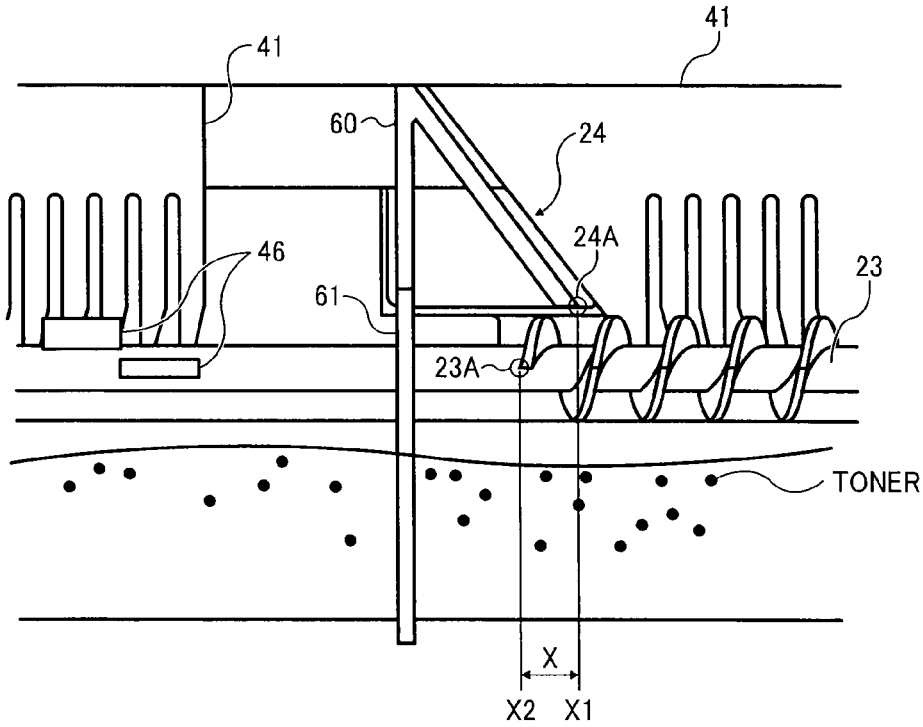
FIG. 12 is a schematic diagram showing a position of screw downstream end portion when the waste-toner tank is not yet filled.

FIG. 12 illustrates a situation in which the waste-toner tank 160 is not yet filled, and accordingly the transport screw 23 does not receive the pressure from the waste toner in the shielded enclosure 24 in the direction indicated by an arrow B. In FIG. 12, reference characters 23A represents an extreme downstream portion of the transport screw 23 in the waste-toner transport direction indicated by an arrow A (hereinafter "screw downstream end portion 23A"), 24A represents an outer end portion of the shielded enclosure 24, and X1 represent a position at which the outer end portion 24A is located.

In the present embodiment, the transport screw 23 is designed so that, in the state shown in FIG. 12, the screw downstream end portion 23A is located at a position X2 that is separated from the position X1 by a distance X in the transport direction.

Figure 13:
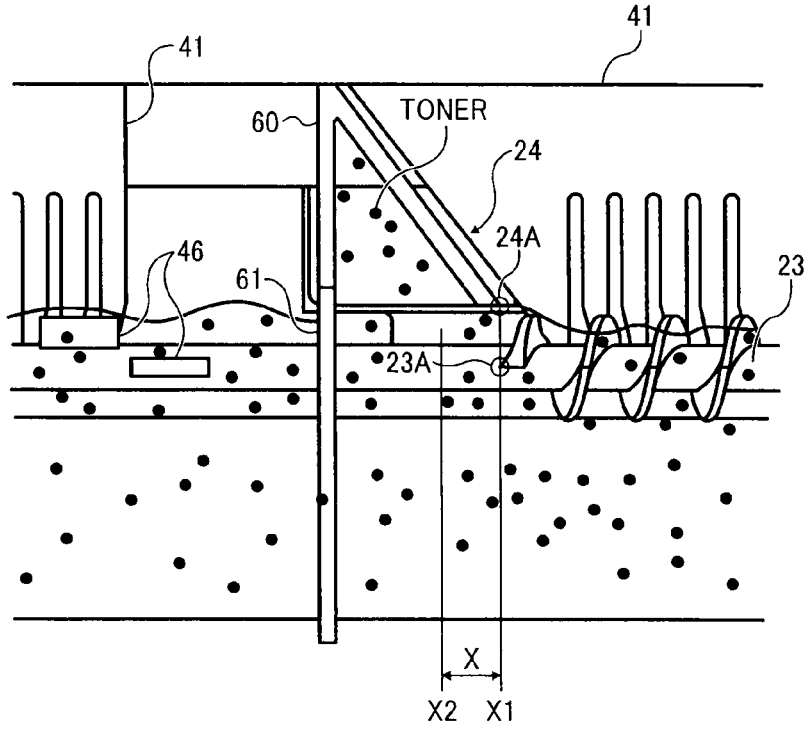
FIG. 13 is a schematic diagram showing a position of a screw downstream end portion when the waste-toner tank is filled.

FIG. 13 shows a state in which the transport screw 23 has moved in the direction opposite the direction in which the waste toner is transported by receiving the pressure from the waste toner in the shielded enclosure 24 from the direction indicated by an arrow B when the waste-toner tank is filled state.

In this state, as the transport screw 23 has moved in the direction opposite the direction in which the waste toner is transported, the screw downstream end portion 23A has traveled from the position X1 to the position X2. In other words, the transport screw 23 has moved the distance X in the opposite direction.

The reason why the transport screw 23 has moved the distance X is described below. When the screw downstream end portion 23A has moved from the position X1 to the position X2, the downstream end portion of screw 23A is pressed out from the shielded enclosure 24, and then, the transport screw 23 does not receive the pressure from the waste toner in the shielded enclosure 24.

As described above, the transport screw 23 moves only the distance X because the transport screw 23 no longer receives the pressure from the waste toner in the shielded enclosure 24 at the position X2.

Therefore, by setting the distance X to be shorter than a distance between the end portion of the transport screw 23 and the casing, the transport screw 23 does not collide with the casing when the transport screw 23 has moved in the opposite direction.

In the present embodiment, the distance between the end portion of the transport screw 23 and the casing is 14 mm, for example, and therefore the distance X can be a distance shorter than 14 mm.

Further, as described above, in the present embodiment, when the axis of the transport screw 23 has moved 3 mm, for example, in the direction opposite the waste-toner transport direction, the light from the light emitting part to the light receiving part of the optical sensor 157 is blocked, and therefore the optical sensor 157 detects that the waste-toner tank 160 is completely or nearly filled with the waste toner.

Thus, the distance X must be 3 mm or greater. Therefore, preferably the distance X is from 3 mm to 10 mm so as to reliably prevent the transport screw 23 from colliding with the casing and to maintain the ability of the optical sensor 157 to detect the transport screw 23. In the present embodiment, the distance X is set to 5 mm, for example.

It is to be noted that the method of detecting the filled state of the waste-toner tank 160 based on the load to the transport screw 23 from the waste toner when the shielded enclosure 24 is filled with the waste toner is not limited to the above-described method including detection of changes in the position of the transport screw 23, but also includes a method including detection of changes in a driving torque or peripheral velocity of the transport screw 23.

Second Embodiment

A second embodiment of the present invention is described below. A configuration of the second embodiment is basically similar to the above-described first embodiment, except that a printer according to the second embodiment includes a door 40 as shown in FIG. 14.

Figure 14:
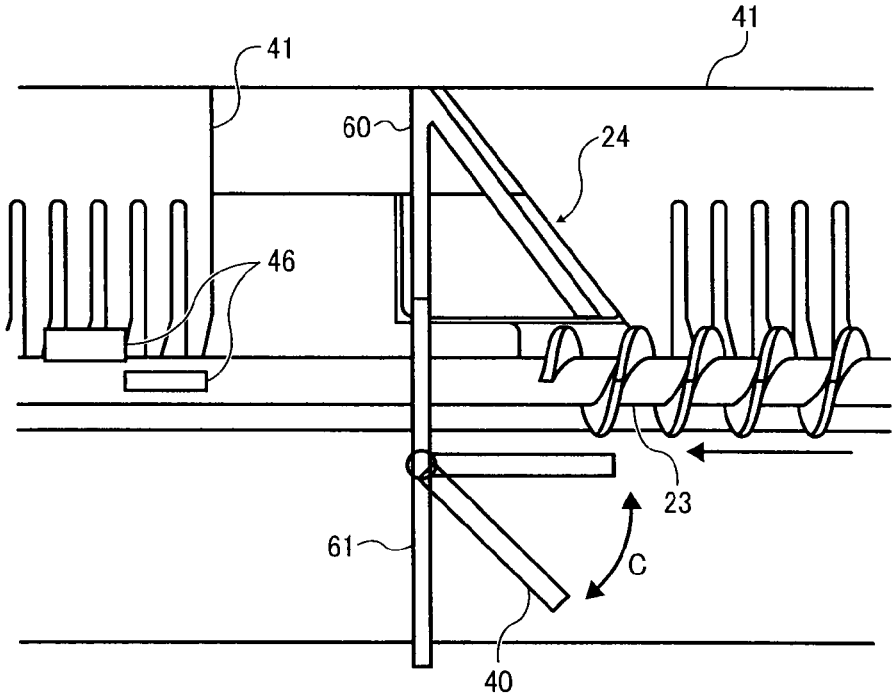
FIG. 14 is a schematic diagram illustrating a belt-cleaning unit according to another embodiment that includes a hinged door beneath a shielded enclosure.

In the present embodiment, the door 40 is located beneath the transport screw 23 in a portion under the shielded enclosure 24 and is hinged so as to be able to swing in a direction indicated by an arrow C in FIG. 14 about an axis provided on the shielding wall 61.

When the predetermined or given amount of the waste toner is accumulated in the waste-toner tank 160, the door 40 is forced upward by the waste toner, closing an aperture in the bottom of the shielded enclosure 24. The aperture in the bottom of the shielded enclosure 24 serves as a connecting port that connects the waste-toner tank 160.

After a predetermined or given amount of the waste toner has accumulated in the waste-toner tank 160, when the transport screw 23 transports the waste toner into the shielded enclosure 24, the configuration can prevent the waste toner from flowing into not the shielded enclosure 24 but the waste-toner tank 160 by closing the aperture of the shielded enclosure 24 with the door 40. That is, the hinged door 40 serves as an accumulation preventer, thereby ensuring that the waste toner is reliably carried into the shielded enclosure 24. As a result, the accuracy with which the filled state of the waste-toner tank 160 is detected can be improved.

Figure 15:
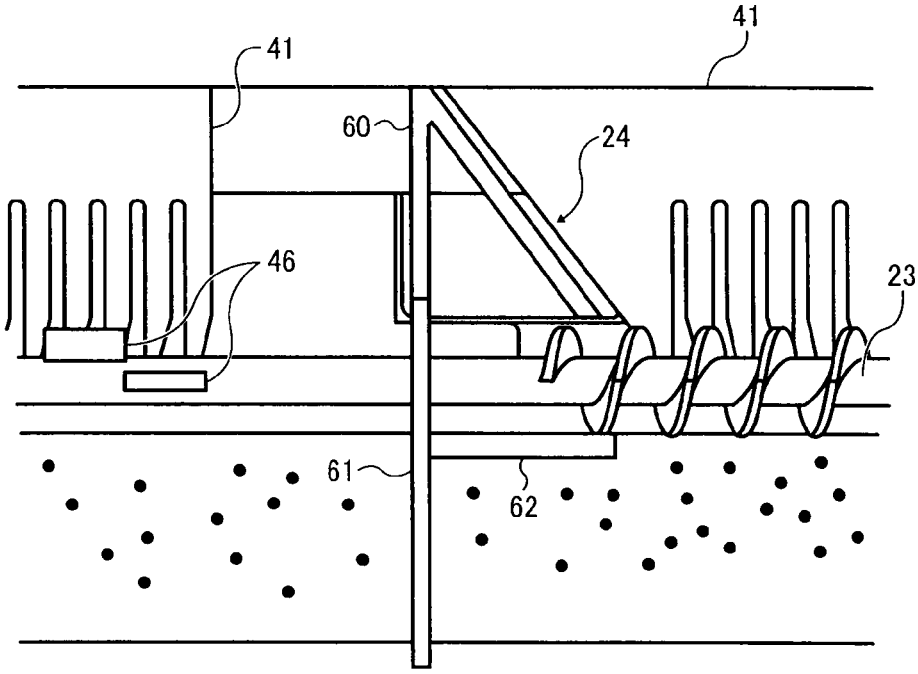
FIG. 15 is a schematic diagram illustrating a variation of the belt-cleaning unit shown in FIG. 14 that includes a shielding wall beneath a shielded enclosure.

It is to be noted that, referring to FIG. 15, a configuration in which the aperture is kept closed by a shielding wall 62 beneath the shielded enclosure 24 is also feasible. When the transport screw 23 transports the waste toner into the shielded enclosure 24, the configuration inhibits the waste toner from flowing into not the shielded enclosure 24 but the waste-toner tank 160. That is, the shielding wall 62 serves as an accumulation preventer.

However, because the aperture beneath the shielded enclosure 24 is openable and closable by providing the door 40, the configuration shown in FIG. 14 has an advantage in recycling the waste-toner tank 160.

That is, in a case in which the waste-toner tank 160 is to be reused after the waste-toner tank 160 once detects the filled state, the waste toner can be discharged from the shielded enclosure 24 so that the waste-toner tank 160 can detect the filled state again. Because the aperture beneath the shielded enclosure 24 can pivot to open the shielded enclosure 24 in the configuration shown in FIG. 14, the waste toner can be easily discharged from the shielded enclosure 24.

If the waste toner that is stored in the shielded enclosure 24 during a previous detection of the filled state still remains in the shielded enclosure 24, the sensor might detect a filled state in error or cannot detect the filled state of the waste-toner tank 160 in a subsequent detection.

Therefore, it is preferable that the printer be designed so that the waste toner can be discharged from the shielded enclosure 24 easily.

Third Embodiment

A belt-cleaning unit according to a third embodiment is described below.

Figure 16:
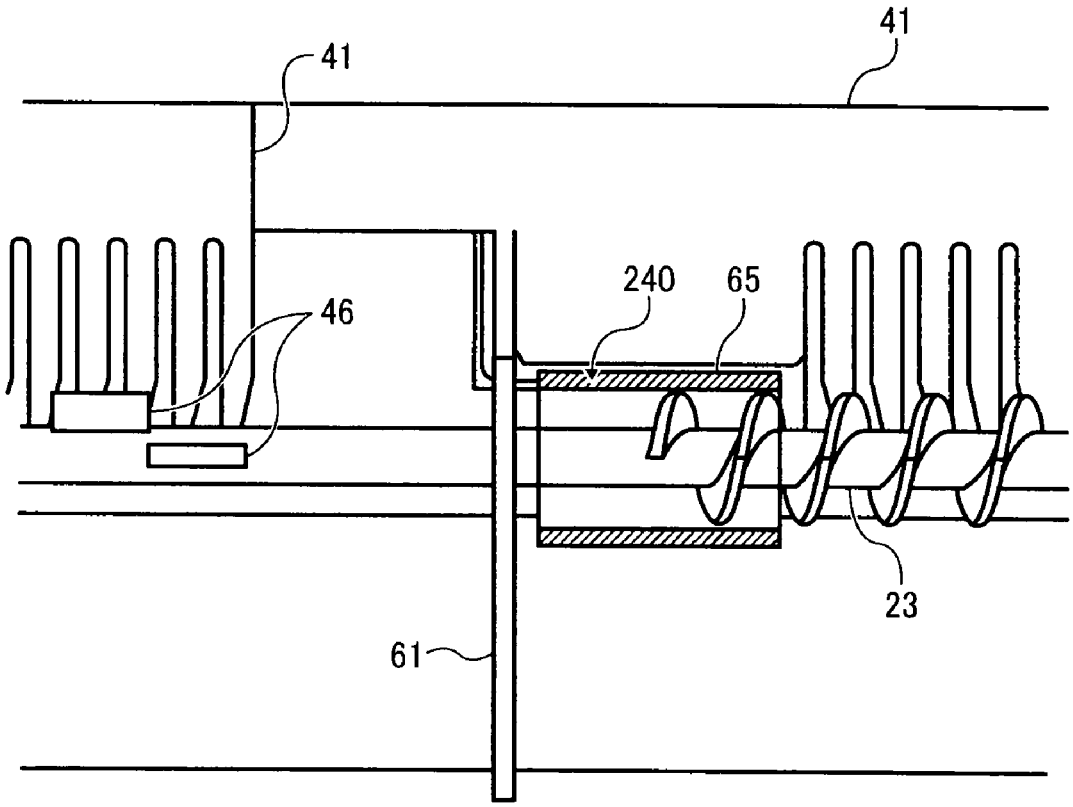
FIG. 16 is a schematic diagram illustrating a belt-cleaning unit according to another embodiment including a shield enclosure formed by a cylindrical member.

Referring to FIG. 16, the fundamental configuration of the third embodiment is nearly similar to the above-described first embodiment, but the belt-cleaning unit 19 of the third embodiment includes a shielded enclosure 240 that is formed by a cylindrical member 65 instead of the shielded enclosure 24 that is shaped like a triangle as shown in FIGS. 5 through 7.

In the present embodiment, by using a cylindrical shielded enclosure 240, an outer circumferential surface of the shielded enclosure 24A is curved, and that curved top surface of the shielded enclosure 24 serves as an accumulation preventer.

Therefore, even if the waste toner that is scraped off by the cleaning blade 20 adheres to the outer circumferential surface of the shielded enclosure 240, the waste toner can fall to the bottom of the waste-toner tank 160 along the curved surface, and consequently, accumulation of the waste toner on the outer circumference of the shielded enclosure 240 can be prevented or reduced.

Further, in the present embodiment, the cylindrical member 65 contacts the transport screw 23 and is rotated by a frictional force generated therebetween.

As described above, by making the cylindrical member 65 that forms the shielded enclosure 240 rotatable, the waste toner adhered thereto can be removed from the outer circumference of the cylindrical member 65 by rotation of the cylindrical member 65 serving as an accumulation preventer.

It is to be noted that the cylindrical member 65 can be connected to the transport screw 23 so as to be rotated by the rotation of the transport screw 23.

In the present embodiment, similarly to the first embodiment, when accumulation of the waste toner in the waste-toner tank 160 is relatively small in amount, the waste toner can fall to the bottom of the waste-toner tank 160 by slipping through the transport screw 23 and transport passage.

However, referring to FIG. 5, when the waste toner has accumulated to close to a lower portion of the transport passage, a bottom of the transport passage is filled with the accumulated waste toner, and therefore, the waste toner serves as a bottom wall of the transport passage.

In the present embodiment, the above-described state is one in which the waste-toner tank 160 is in a filled state. When the waste toner has accumulated in the waste-toner tank 160 to the filled state, the waste toner that accumulates after the filled state is reached can be transported to the shielded enclosure 240 by the transport screw 23.

In the present embodiment, the filled state of the waste-toner tank 160 is determined by detecting a driving torque for driving the transport screw 23 to press the waste toner into the shielded enclosure 240.

In other words, when the shielded enclosure 240 is filled with the waste toner that is transported by the transport screw 23, the transport screw 23 cannot press the waste toner into the shielded enclosure 240.

In this case, a force to hinder the transportation of the transport screw 23 by the waste toner is generated, and thus the driving torque required to rotate the transport screw 23 increases. Therefore, by detecting the increase in the driving torque, the filled state of the waste-toner tank 160 can be detected.

It is to be noted that the relation between the size of the driving torque and the size of an electric current that flows through the driving motor, not shown, that drives the transport screw 23 is calculated in advance, and thus the power of the driving torque can be determined by detecting the current flowing through the driving motor.

Moreover, as shown in the first embodiment, the filled state of the waste-toner tank 160 can be detected by detecting changes in the position of the transport screw 23.

Numerous additional modifications and variations are possible in light of the above teachings. It is therefore to be understood that, within the scope of the appended claims, the disclosure of this patent specification may be practiced otherwise than as specifically described herein.

What is claimed is:

1. A powder container comprising:

a first container to contain powder falling from an opening located in an upper portion of the powder container;

a second container to contain the powder, located in the first container, on a route through which the powder that falls from the opening;

a powder transport mechanism to transport the powder from the first container to the second container; and a detection mechanism to detect whether or not the first container is completely or nearly filled with the powder based on a load to the powder transport mechanism.

2. The powder container according to claim 1, wherein the powder transport mechanism is movable in an axial direction, and the detection mechanism is a position sensor that detects a change in position of the powder transport mechanism.

3. The powder container according to claim 1, further comprising:

an accumulation preventer to prevent the powder from accumulating on the second container.

4. The powder container according to claim 3, wherein the accumulation preventer is a sloped top surface of the second container.

5. The powder container according to claim 3, wherein the accumulation preventer is a curved top surface of the second container.

6. The powder container according to claim 3, wherein, as the accumulation preventer, the second container is configured as a cylindrical tubular rotary member.

7. The powder container according to claim 3, wherein the accumulation preventer is a cleaning member disposed above the second container that cleans at least the top surface of the second container.

8. The powder container according to claim 7, wherein the cleaning member is an elastic sheet including a slit portion.

9. The powder container according to claim 1, further comprising:

a connecting port to connect the first container and the second container; and an openably closable mechanism to open and close the connecting port.

10. The powder container according to claim 9, wherein the openably closable mechanism closes when a predetermined amount of the powder accumulates in the first container.

11. A cleaning device comprising;

a cleaning component to collect powder from an object to be cleaned; and a powder container to contain the powder that is collected by the cleaning component and falls under its own weight;

the powder container comprising:

a first container to contain powder falling from an opening located in an upper portion of the powder container;

a second container to contain powder, located in the first container, on a route through which the powder falls from the opening;

a powder transport mechanism to transport the powder from the first container to the second container; and a detection mechanism to detect whether or not the first container is completely or nearly filled with the powder, based on a load from the powder transport mechanism.

12. An image forming apparatus comprising;

an image forming unit to form an image on an image carrier; and a cleaning device to remove powder on the image carrier, the cleaning device comprising:

a cleaning component to collect the powder from a cleaned mechanism; and a powder container to contain the powder that is collected by the cleaning component and falls under its own weight;

a powder container comprising:

a first container to contain powder falling from an opening located in an upper portion of the powder container;

a second container to contain powder, located in the first container, on a route through which the powder falls from the opening;

a powder transport mechanism to transport the powder from the first container to the second container; and, a detection mechanism to detect whether or not the first container is completely or nearly filled with the powder, based on a load from the powder transport mechanism.

13. The image forming apparatus according to claim 12, wherein the detection mechanism is located outside of the first container.

14. The image forming apparatus according to claim 13, wherein the detection mechanism comprises:

a detected member; and a sensor to detect the detected member, wherein the sensor of the detection mechanism detects whether or not the first container is completely or nearly filled with the powder by moving the detected member based on the load from the powder transport mechanism.

* * * * *